US011486293B2

(12) United States Patent
Samdaeng et al.

(10) Patent No.: US 11,486,293 B2
(45) Date of Patent: Nov. 1, 2022

(54) EXHAUST STRUCTURE OF INTERNAL COMBUSTION ENGINE

(71) Applicant: Honda Motor Co., Ltd., Tokyo (JP)

(72) Inventors: Ratchawat Samdaeng, Bangkok (TH); Thachakorn Weerapanyakulthavee, Bangkok (TH); Sahachai Lerdpakavanich, Bangkok (TH)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/005,351

(22) Filed: Aug. 28, 2020

(65) Prior Publication Data

US 2022/0065155 A1 Mar. 3, 2022

(51) Int. Cl.

| | |
|---|---|
| ***F01N 13/10*** | (2010.01) |
| ***F02F 1/24*** | (2006.01) |
| ***F01N 13/18*** | (2010.01) |

(52) U.S. Cl.

CPC ..... *F01N 13/10* (2013.01); *F02F 1/243* (2013.01); *F01N 13/1805* (2013.01); *F01N 2260/20* (2013.01); *F01N 2340/02* (2013.01)

(58) Field of Classification Search

CPC .... F02F 1/4271; F02F 1/4292; F02F 2200/06; Y10T 29/49272; F01N 13/10; F02M 31/087; F01P 3/14

See application file for complete search history.

(56) References Cited

U.S. PATENT DOCUMENTS

| | | | | |
|---|---|---|---|---|
| 2,737,171 A * | 3/1956 | Pier | F02B 77/02 | 123/193.1 |
| 3,786,795 A * | 1/1974 | Kaneko | F02B 77/02 | 123/193.5 |
| 3,902,853 A * | 9/1975 | Marsee | F01N 3/2889 | 422/171 |
| 3,916,850 A * | 11/1975 | Date | F02M 31/087 | 123/184.41 |
| 4,031,699 A * | 6/1977 | Suga | F02B 77/02 | 60/282 |

(Continued)

FOREIGN PATENT DOCUMENTS

| | | |
|---|---|---|
| JP | S58091349 | 5/1983 |
| JP | S6023484 | 7/1985 |

(Continued)

*Primary Examiner* — Anthony Ayala Delgado
(74) *Attorney, Agent, or Firm* — JCIPRNET

(57) ABSTRACT

An exhaust structure of an internal combustion engine having an exhaust passage communicating between an exhaust port and an exhaust pipe. The exhaust structure includes a heat insulating component covering an inner wall of the exhaust port, the heat insulating component includes a first abutting portion disposed at a first side of the heat insulating component at a combustion chamber side and abutting an inner wall of the exhaust port, a second abutting portion disposed at a second side of the heat insulating component at an exhaust pipe side and abutting the inner wall, and a middle section disposed between the first side and the second side. A gap is formed between the middle section and the inner wall, and a bent portion connecting the middle section and the first abutting portion is bending toward the inner wall of the exhaust port from the middle section.

4 Claims, 8 Drawing Sheets

(56) References Cited

U.S. PATENT DOCUMENTS

| | | | | | |
|---|---|---|---|---|---|
| 4,103,487 | A * | 8/1978 | Yamazaki | F02B 77/02 | 123/193.5 |
| 4,123,902 | A * | 11/1978 | Iida | F01N 3/26 | 123/193.5 |
| 4,207,660 | A * | 6/1980 | Rao | B23P 15/00 | 123/193.5 |
| 4,430,856 | A * | 2/1984 | Niedert | F02F 1/4271 | 60/272 |
| 4,539,812 | A * | 9/1985 | Rezy | F01P 3/14 | 60/304 |
| 4,715,178 | A * | 12/1987 | Tsukuda | F02B 77/02 | 123/193.5 |
| 5,239,956 | A * | 8/1993 | Keelan | B22C 1/00 | 123/193.5 |
| 6,571,762 | B2 * | 6/2003 | Rieger | F02B 77/02 | 123/193.5 |

FOREIGN PATENT DOCUMENTS

| | | |
|---|---|---|
| JP | H04113763 | 10/1992 |
| JP | H05042660 | 6/1993 |

* cited by examiner

EXHAUST STRUCTURE OF INTERNAL COMBUSTION ENGINE

BACKGROUND OF THE DISCLOSURE

Technical Field

The disclosure relates to an internal combustion engine and an exhaust structure thereof.

Related Art

Conventionally, in an internal combustion engine, a heat insulating material or a heat insulating layer is provided at an exhaust port of the internal combustion engine in order to maintain a good activity state of a catalytic converter which is disposed at an exhaust pipe. Related art teaches that by providing the heat insulating material or the heat insulating layer (also known as a port liner), a decrease in temperature of the exhaust gas due to heat transferring to a cylinder head of the engine may be suppressed. For example, to fix the port liner to the cylinder head: Patent Literature 1 and Patent Literature 2 disclose the port liner and the cylinder head casted together. Patent Literature 3 discloses providing a support part at the cylinder head. Patent Literature 4 discloses providing a fixing component such as a valve sheet in a case when the port liner and the cylinder head are provided separately.

LITERATURE OF RELATED ART

Patent Literature

Patent Literature 1: Japanese Laid-Open No. H4-113763
Patent Literature 2: Japanese Laid-Open No. H5-42660
Patent Literature 3: Japanese Laid-Open No. S60-23484
Patent Literature 4: Japanese Laid-Open No. S58-91349

However, in each configuration, a manufacturing process for attaching the port liner to the cylinder head is complex. Therefore, a simple way of attaching the port liner to the cylinder head is needed.

SUMMARY

According to an embodiment of the disclosure, an exhaust structure installed in an internal combustion engine having an exhaust passage that communicates between an exhaust port of a combustion chamber and an exhaust pipe is provided. The exhaust structure includes a heat insulating component covering at least a portion of an inner wall of the exhaust port. The heat insulating component includes a first abutting portion, a second abutting portion, a middle section and a bent portion. The first abutting portion is disposed at a first side of the heat insulating component at a combustion chamber side and abutting an inner wall of the exhaust port. The second abutting portion is disposed at a second side of the heat insulating component at an exhaust pipe side and abutting the inner wall of the exhaust port. The middle section is disposed between the first side and the second side of the heat insulating component, wherein a gap is formed between the middle section of the heat insulating component and the inner wall of the exhaust port. The bent portion connects the middle section and the first abutting portion and bends toward the inner wall of the exhaust port from the middle section.

According to an embodiment of the disclosure, a distance between the bent portion and the inner wall in a radial direction of the heat insulating component changes gradually in an axial direction of the heat insulating component.

According to an embodiment of the disclosure, the bent portion is bent such that the first abutting portion is disposed closer to the exhaust pipe side than a connecting point connecting the middle section and the bent portion.

According to an embodiment of the disclosure, the bent portion is configured to be deformed so that a formed angle between the middle section and the bent portion increases with a receiving heat.

According to an embodiment of the disclosure, the bent portion is bent such that the first abutting portion is disposed closer to the combustion chamber side than a connecting point connecting the middle section and the bent portion, and the first abutting portion abuts and extends along the inner wall of the exhaust port.

According to an embodiment of the disclosure, the bent portion is provided in an annular shape.

According to an embodiment of the disclosure, the bent portion is configured such that the first abutting portion abuts at least a portion of the inner wall of the exhaust port which is located at an upper part of the exhaust port related to a base portion of the internal combustion engine.

BRIEF DESCRIPTION OF THE DRAWINGS

Embodiments will now be described, by way of example only, with reference to the accompanying drawings which are meant to be exemplary, not limiting, and wherein like elements are numbered alike in several Figures.

DESCRIPTION OF THE EMBODIMENTS

Figure 1:
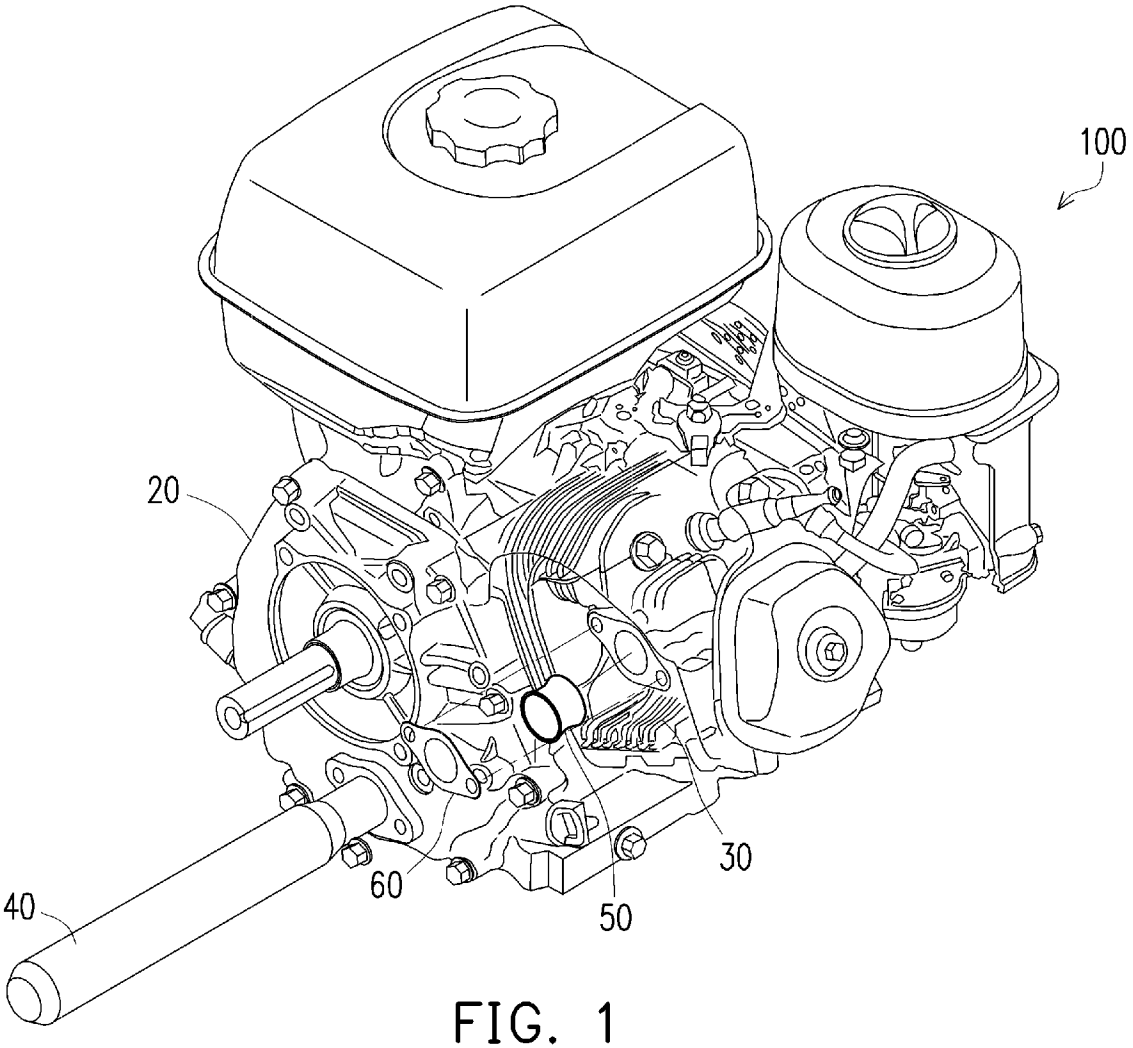
FIG. 1 is a perspective view diagram schematically showing an exhaust structure adapted to be installed in an internal combustion engine according to an exemplary embodiment of the disclosure.
Figure 2:
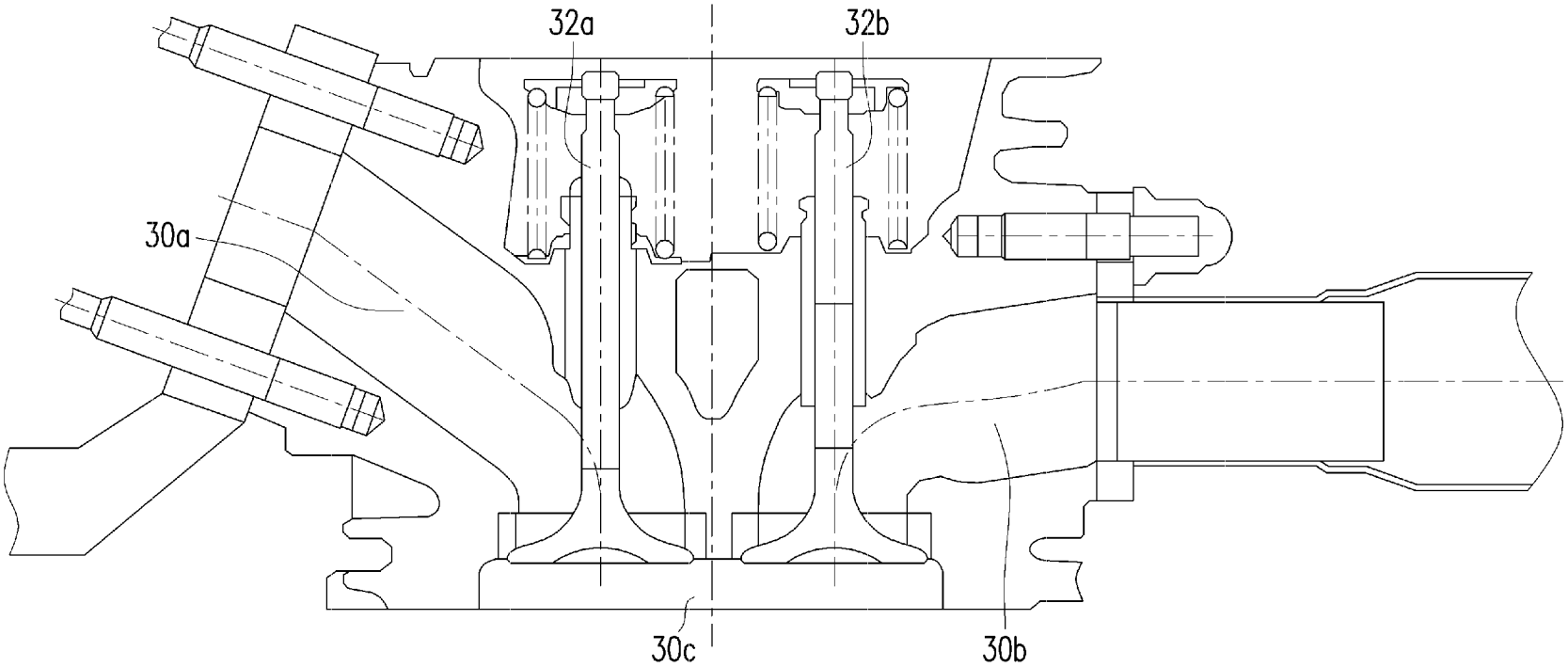
FIG. 2 is a cross-sectional diagram schematically showing a cylinder head of the internal combustion engine according to an exemplary embodiment of the disclosure.

According to an exemplary embodiment of the disclosure, an exhaust structure of an internal combustion engine is provided. FIG. 1 is a perspective view diagram schematically showing an exhaust structure adapted to be installed in an internal combustion engine according to exemplary embodiment of the disclosure. In FIG. 1, an exhaust pipe 40, a port liner 50 and a gasket 60 are shown in an expanded view from a cylinder head 30. FIG. 2 is a cross-sectional diagram schematically showing a cylinder head of the internal combustion engine according to an exemplary embodiment of the disclosure. In FIG. 2, the port liner 50 disposed in the exhaust structure is not shown.

Referring to FIG. 1 and FIG. 2, the internal combustion engine 100 includes an engine block 20, a cylinder head 30, the exhaust pipe 40, the port liner 50, and the gasket 60. The cylinder head 30 is disposed on and coupled to the engine block 20. The cylinder head 30 has an intake port 30*a* communicating the atmosphere (outside) with a combustion chamber 30*c* of the internal combustion engine 100, and an exhaust port 30*b* communicating the combustion chamber 30*c* of the internal combustion engine 100 with the atmosphere (outside). The intake port 30*a* provides a passage for intake air to flow into the combustion chamber 30*c* for combustion. The exhaust port 30*b* provides a passage for exhaust gas to flow out of the combustion chamber 30*c* after combustion. The gasket 60 is disposed between the exhaust pipe 40 and the exhaust port 30*b* of the cylinder head 30. In addition, an intake valve 32*a* is disposed between the intake port 30*a* and the combustion chamber 30*c* to control a timing for the flow of intake air from the atmosphere into the combustion chamber 30*c*. An exhaust valve 32*b* is disposed between the combustion chamber 30*c* and the exhaust port 30*b* to control a timing for the flow of exhaust gas from the combustion chamber 30*c* to the atmosphere.

Figure 3A:
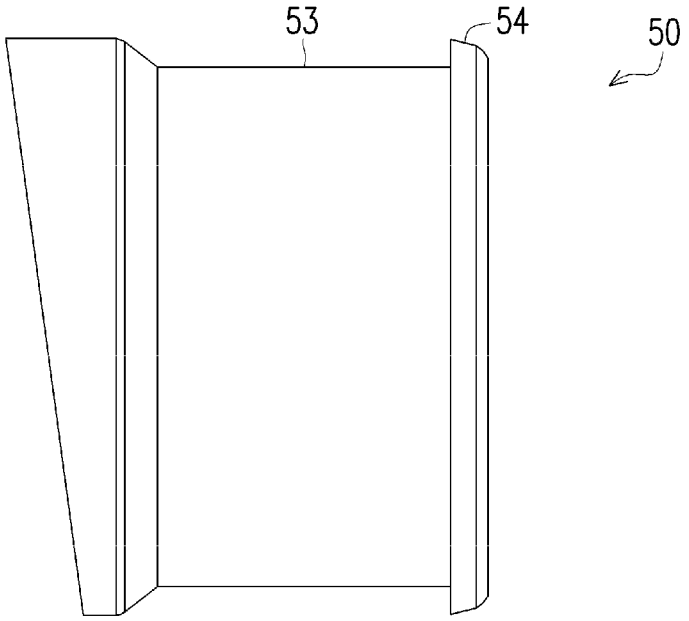
FIG. 3A is a front view diagram schematically showing a heat insulating component of the exhaust structure according to a first embodiment of the disclosure.
Figure 3B:
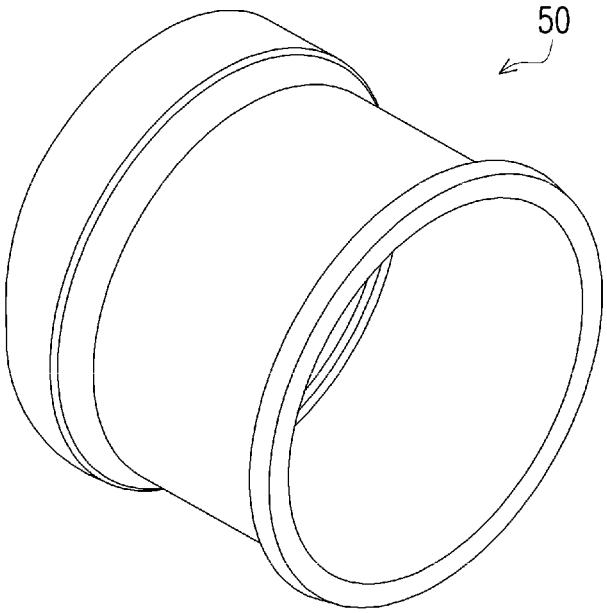
FIG. 3B is a perspective view diagram of FIG. 3A.

FIG. 3A is a front view diagram schematically showing a heat insulating component of the exhaust structure according to a first embodiment of the disclosure. FIG. 3B is a perspective view diagram of FIG. 3A. Referring to FIG. 3A and FIG. 3B, the port liner 50 is an example of a heat insulating component of the disclosure. The port liner 50 is formed in a hollowed cylindrical shape with a hollow portion O. The port liner 50 is formed, for example, by an alloy material. It is preferable the port liner 50 is formed from a material having low thermal conductivity. Also, the port liner 50 is made of a material having a lower al expansion coefficient than that of the exhaust port 30*b* of the cylinder head 30.

Figure 4:
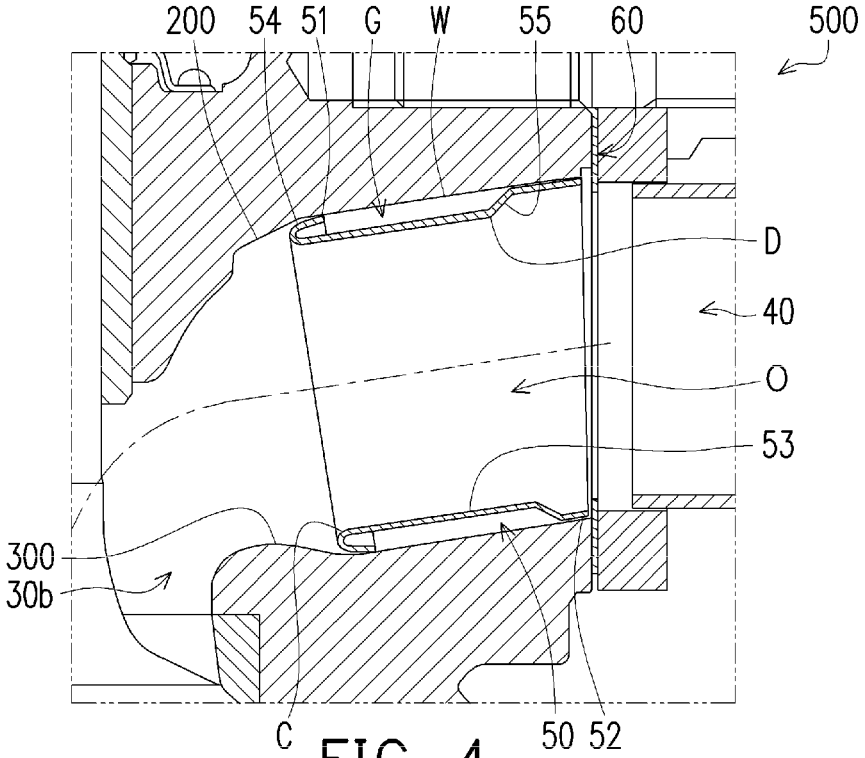
FIG. 4 is a cross sectional diagram schematically showing the exhaust structure of the internal combustion engine according to the first embodiment of the disclosure.

FIG. 4 is a cross sectional diagram schematically showing an exhaust structure of the internal combustion engine according to a first embodiment of the disclosure. Referring to FIG. 4, an exhaust structure 500 is shown. The port liner 50 is disposed inside the exhaust port 30*b* of the cylinder head 30, wherein exhaust gas from the exhaust port 30*b* passes through the hollow portion O of the port liner 50 and is exhausted toward the exhaust pipe 40. The port liner 50 covers at least a portion of an inner wall W of the exhaust port 30*b*. The port liner 50 includes a first abutting portion 51, a second abutting portion 52, a middle section 53, a bent portion 54 and a trailing bend 55. The first abutting portion 51 is disposed at a first side of the port liner 50 at an combustion chamber side and abuts the inner wall W of the exhaust port 30*b*. That is, the first side of the port liner 50 is a side of the port liner 50 closer to the combustion chamber 30*c*. The second abutting portion 52 is disposed at a second side of the port liner 50 at an exhaust pipe side and abuts the inner wall W of the exhaust port 30*b*. That is, the second side of the port liner 50 is a side of the port liner 50 closer to the exhaust pipe 40. Here, the second side is a side of the port liner 50 opposite to the first side. Namely, in a case when the port liner 50 is assembled to the cylinder head 30, the second abutting portion 52 is located nearer to the exhaust pipe 40 than the first abutting portion 51.

Furthermore, the middle section 53 is disposed between the first side and the second side of the port liner 50. In other words, the middle section 53 is disposed between the first abutting portion 51 and the second abutting portion 52 of the port liner 50. The middle section 53 is raised up from the inner wall W of the exhaust port 30*b*, such that a gap G is formed between the middle section 53 of the port liner 50 and the inner wall W of the exhaust port 30*b*. The gap G acts as a heat insulating layer to suppress a decrease in temperature of the exhaust gas, and suppresses heat transferring to the cylinder head 30.

The bent portion 54 is a portion of the port liner 50 which connects the middle section 53 to the first abutting portion 51. More specifically, the bent portion 54 connects the middle section 53 to the first abutting portion 51 by bending outward in the radial direction of the port liner 50 and towards the inner wall W of the exhaust port 30*b* such that the first abutting portion 51 abuts the inner wall W of the exhaust port 30*b*. That is to say, in a radial direction of the port liner 50, a distance from the first abutting portion 51 to a center axis of the port liner 50 is larger than a distance from the middle section 53 to the center axis.

It should be noted, in a radial direction of the port liner 50, a distance between the bent portion 54 and the inner wall W in a radial direction of the port liner 50 changes gradually in an axial direction of the port liner 50. In other words, the bent portion 54 does not make a 90 degree angle with the inner wall W of the exhaust port 30*b*. Namely, the angle formed between the bent portion 54 and the inner wall W is not 90 degrees. When the bent portion 54 is configured to make a 90 degree angle with the inner wall W, the port liner 50 may be pushed back towards the exhaust pipe 40 by a force of the exhaust gas due to a large resistance force to the flow of exhaust gas created by the bent portion 54. By gradually increasing the distance between the bent portion 54 and the inner wall W from the first abutting portion 51 towards the combustion chamber side, a position of the port liner 50 may be fixed while preventing the bent portion 54 from generating an excessive resistance to the flow of exhaust gas flowing out of the combustion chamber 30*c*.

Furthermore, in the first embodiment shown in FIG. 4, a connecting point C is defined as a point connecting the bent portion 54 and the middle section 53, the bent portion 54 is bent such that the first abutting portion 51 is disposed closer to the exhaust pipe side than the connecting point C. In other words, the bent portion 54 is formed by outwardly folding the annular edge of the port liner 50 at the combustion chamber side, so that the bent portion 54 is outwardly curved with a center of the radius of curvature of the bent portion 54 being located outside the port liner 50. In such a configuration, in relation to the axial direction of the port liner 50, the bent portion 54 is located nearer to the combustion chamber side than the first abutting portion 51, the connecting point C is located between the bent portion 54 and the middle section 53, and the first abutting portion 51 is located nearer to the exhaust pipe side than both of the bent portion 54 and the connecting point C. By this design, when the port liner 50 is inserted into the exhaust port 30*b* from the exhaust pipe side, the resistance by the bent portion 54 is suppressed, and attachability is improved.

Figure 5:
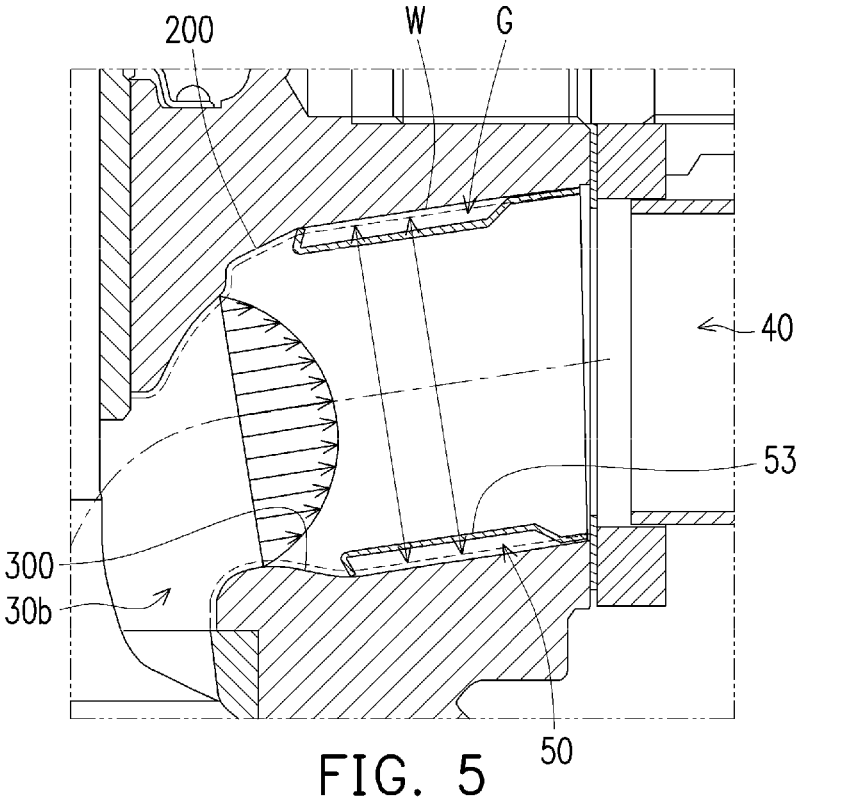
FIG. 5 is a cross sectional diagram schematically showing a flow of exhaust gas in the exhaust structure of FIG. 4.

FIG. 5 is a cross sectional diagram schematically showing a flow of exhaust gas in the exhaust structure of FIG. 4. Referring to FIG. 5, a flow rate of the exhaust gas is shown. A center portion of the exhaust port 30*b* has a higher flow rate of exhaust gas. The flow rate of exhaust gas decreases gradually from the center portion of the exhaust port to the inner wall W of the exhaust port 30*b*. It should be noted, the port liner 50 expands when pressure from the exhaust gas is received due to thermal deformable property of the port liner 50. In addition, the middle section 53 of the port liner 50 expands outward in the radial direction towards the inner wall W of the exhaust port 30*b*. However, the middle section 53 does not contact the inner wall W.

Figure 6:
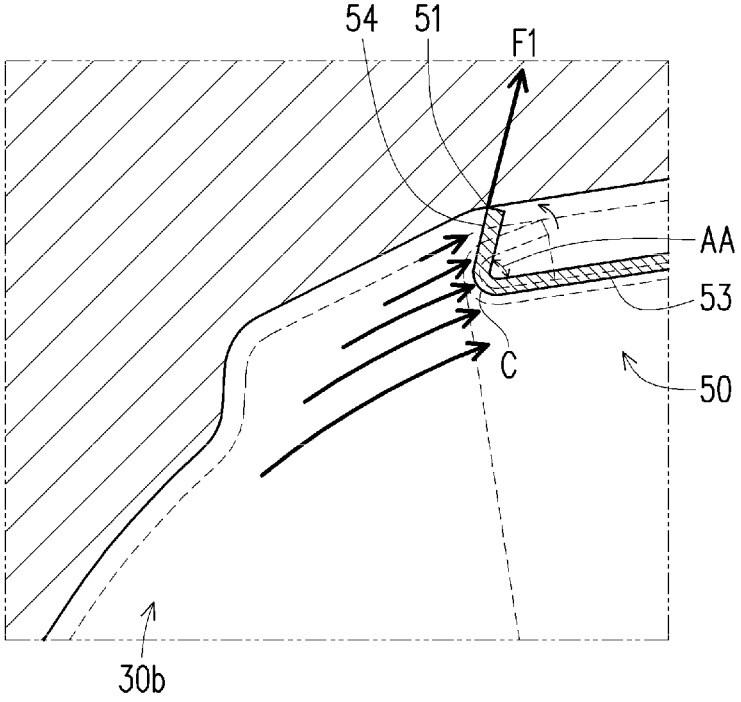
FIG. 6 is a cross sectional diagram schematically showing an enlarged view of a bent portion of a heat insulating component of FIG. 5.

FIG. 6 is a cross sectional diagram schematically showing an enlarged view of a bent portion of a heat insulating component of FIG. 5. Referring to FIG. 6, the bent portion 54 is configured to be deformed so that a formed angle AA between the middle section 53 and the bent portion 54 increases with a receiving heat. Namely, the bent portion 54 elastically deforms with the receiving heat, wherein the shape returns when cooled. Furthermore, during the operation state of the engine, as the temperature increases, due to the thermal deformable property of the port liner 50, the port liner 50 expands when the pressure of the exhaust gas is subjected to the port liner 50 from the hollow portion O of the port liner 50, and the subjected abutting force F1 to the inner wall W of the exhaust port 30*b* via the first abutting portion 51 may increase with deformation of the expanded port liner 50. In more detail, after the port liner 50 is attached inside the exhaust port 30*b*, the bent portion 54 is configured to deform by receiving heat such as the heat from the exhaust gas accompanying the start of the engine (turning on the ignition). When heat is received, the bent portion 54 is deformed in a way such that resistance to the flow of exhaust gas flowing from the combustion chamber 30*c* towards the exhaust pipe side is increased. That is, in the first embodiment, since the bent portion 54 is bent such that the first abutting portion 51 is disposed closer to the exhaust pipe side than the connecting point C, the formed angle AA between the middle section 53 and the bent portion 54 increases with the receiving heat such that resistance to the flow of exhaust gas is increased. The formed angle AA formed during the operation state of the engine with a higher temperature in the exhaust structure 500 is larger than the formed angle AA formed during the non-operation state of the engine with a lower temperature in the exhaust structure 500, however the port liner 50 is configured such that the formed angle AA may be less than 90 degrees during both of the operation state and non-operation state of the engine. As a result, due to the effect from the flow of exhaust gas, the first abutting portion 51 is more strongly pressed toward the inner wall W such that the port liner 50 is more strongly fixed. Here, when the bent portion 54 is deformed, a location at which the first abutting portion 51 abuts the inner wall W is moved towards the combustion chamber 30*c*.

In the present embodiment, the bent portion 54 is provided in an annular shape. By hollowing the center portion O of the port liner 50, the pressure of the exhaust gas flowing near the inner wall W of the exhaust port 30*b* may be received by an entire circumferential surface of the port liner 50 such that the port liner 50 is more strongly fixed, without blocking the flow of the exhaust gas.

Furthermore, the bent portion 54 is configured such that the first abutting portion 51 abuts at least a portion of the inner wall W of the exhaust port 30*b* which is located at an upper part of the exhaust port 30*b* related to a base portion of the internal combustion engine 100. That is to say, the first abutting portion 51 abuts at least the inner wall W of the exhaust port 30*b* at an outside circumference 200 where the exhaust gas hits the inner wall W of the exhaust port 30*b* particularly hard, By providing the first abutting portion 51 of the port liner 50 at a location in the exhaust port 30*b* where the exhaust gas flowing in the curved path hits particularly hard (the flow speed is fast), a force of the exhaust gas is more strongly received, such that the port liner 50 is more strongly fixed.

It should be noted, the flow of exhaust gas in the exhaust structure 500 shown in FIG. 5 depicts a slower velocity of exhaust gas near the inner wall W of the exhaust port 30*b* as compared to the center portion. However, experiments show that, if the flow rate of the exhaust gas measured at the upper part of the exhaust port 30*b* that is located at the outside circumference 200 of the exhaust port 30*b* related to the base portion of the internal combustion engine 100 is compared with the flow rate of the exhaust gas measured at the lower part of the exhaust port 30*b* that is located at an inside circumference 300 of the exhaust port 30*b* at the base portion of the internal combustion engine 100, the flow rate of the exhaust gas flowing along the curved path of the outside circumference 200 hits particularly harder, i.e., the flow rate is larger, than that flowing at the inside circumference 300.

The trailing bend 55 is a portion of the port liner 50 which connects the middle section 53 to the second abutting portion 52, More specifically, the trailing bend 55 connects the middle section 53 to the second abutting portion 52 by bending outward in the radial direction of the port liner 50 and towards the inner wall W of the exhaust port 30*b* such that the second abutting portion 52 abuts the inner wall W of the exhaust port 30*b*. That is to say, in a radial direction of the port liner 50, a distance from the second abutting portion 52 to the center axis of the port liner 50 is larger than a distance from the middle section 53 to the center axis.

The trailing bend 55 is bent such that the second abutting portion 52 is disposed closer to the exhaust pipe side than a connecting point D connecting the middle section 53 and the trailing bend 55, and the second abutting portion 52 abuts and extends along the inner wall W of the exhaust port 30*b* and connects with the middle section 53. It should be noted, a distance between the trailing bend 55 and the inner wall W increases gradually from the second abutting portion 52 to the middle section 53 of the port liner 50. In other words, the trailing bend 55 does not make a 90 degree angle with the inner wall W of the exhaust port 30*b*.

The exhaust structure of the internal combustion engine according to the first embodiment is described above. Next, an exhaust structure of the internal combustion engine according to a second embodiment is described below.

Figure 7A:
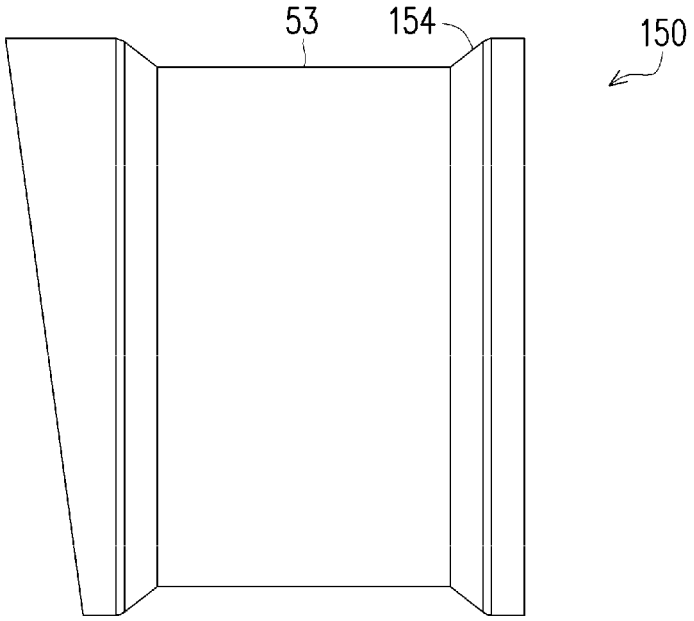
FIG. 7A is a front view diagram schematically showing a heat insulating component of the exhaust structure according to a second embodiment of the disclosure.
Figure 7B:
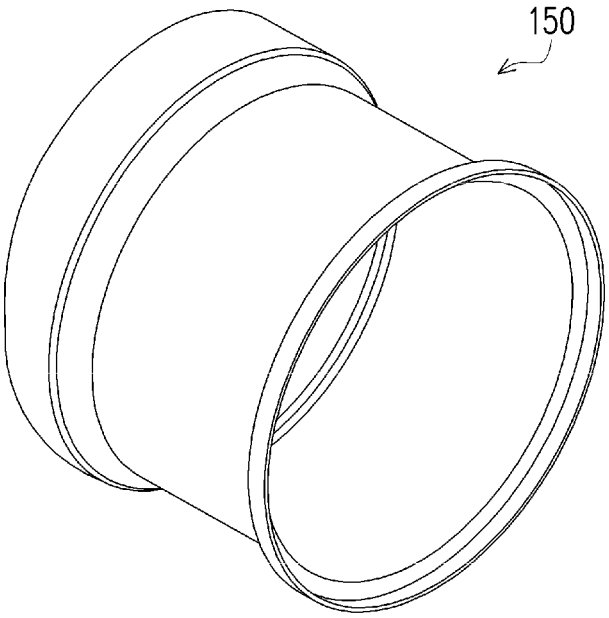
FIG. 7B is a perspective view diagram of FIG. 7A.

FIG. 7A is a front view diagram schematically showing a heat insulating component of the exhaust structure according to a second embodiment of the disclosure. FIG. 7B is a perspective view diagram of FIG. 7A. Referring to FIGS. 7A and 7B, a port liner 150 is an example of a heat insulating component of the disclosure. The port liner 150 is formed in a hollow cylindrical shape with a hollow portion O. The port liner 150 is formed, for example, by an alloy material. It is preferable the port liner 150 is formed from a material having low thermal conductivity. Also, the port liner 150 is made of a material having a lower thermal expansion coefficient than that of the exhaust port 30*b* of the cylinder head 30.

Figure 8:
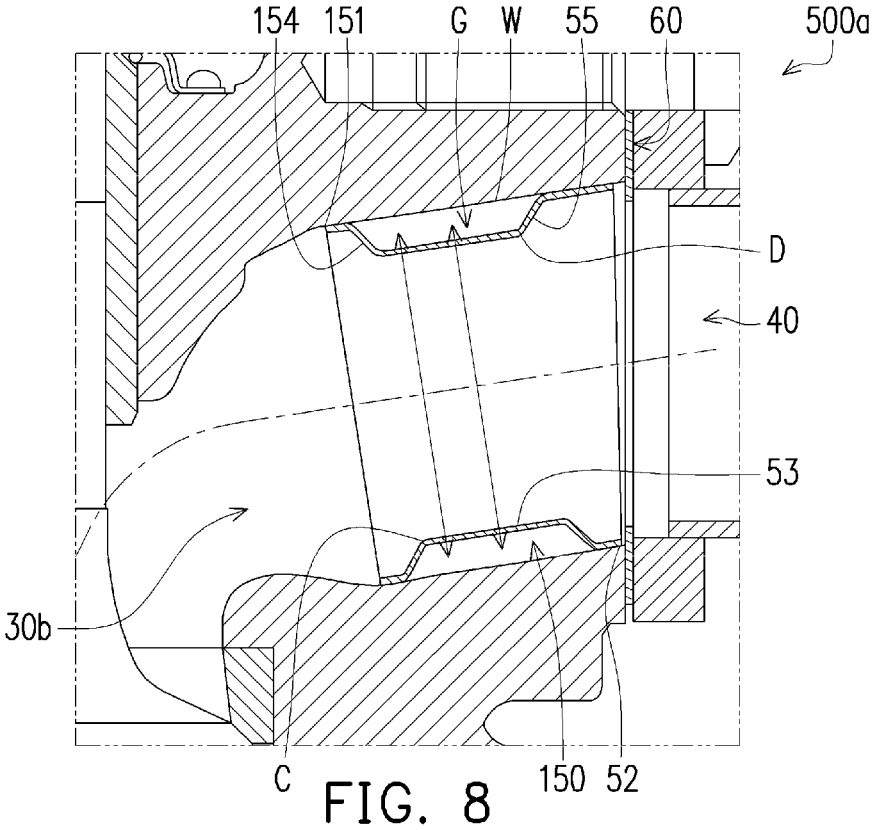
FIG. 8 is a cross sectional diagram schematically showing the exhaust structure of the internal combustion engine according to the second embodiment of the disclosure.

FIG. 8 is a cross sectional diagram schematically showing an exhaust structure of the internal combustion engine according to a second embodiment of the disclosure. Since a basic configuration of the exhaust structure of the second embodiment is the same as that of the first embodiment, the same parts are denoted by the same reference numerals and description thereof is omitted. A main difference between the first embodiment and the second embodiment is in a configuration of the port liner.

Referring to FIG. 8, an exhaust structure 500*a* is shown. A port liner 150 is disposed inside the exhaust port 30*b* of the cylinder head 30, wherein exhaust gas passes through the hollow portion O of the port liner 150. The port liner 150 covers at least a portion of an inner wall W of the exhaust port 30*b*. The port liner 150 includes a first abutting portion 151, a second abutting portion 52, a middle section 53, a bent portion 154 and a trailing bend 55. The first abutting portion 151 is disposed at a first side of the port liner 150 at an combustion chamber side and abuts the inner wall W of the exhaust port 30*b*. That is, the first side of the port liner 150 is a side of the port liner 150 closer to the combustion chamber 30*c*. The second abutting portion 52 is disposed at a second side of the port liner 150 at an exhaust pipe side and abuts the inner wall W of the exhaust port 30*b*. That is, the second side of the port liner 150 is a side of the port liner 150 closer to the exhaust pipe 40. Here, the second side is a side of the port liner 150 opposite to the first side. Namely, in a case when the port liner 150 is assembled to the cylinder head 30, the second abutting portion 52 is located nearer to the exhaust pipe 40 than the first abutting portion 151.

Furthermore, the middle section 53 is disposed between the first side and the second side of the port liner 150. In other words, the middle section 53 is disposed between the first abutting portion 151 and the second abutting portion 52 of the port liner 150. The middle section 53 is raised up from the inner wall W of the exhaust port 30*b*, such that a gap G is formed between the middle section of the port liner 150 and the inner wall W of the exhaust port 30*b*. The gap G acts as a heat insulating layer to suppress a decrease in temperature of the exhaust gas, and suppresses heat transferring to the cylinder head 30.

The bent portion 154 is a portion of the port liner 150 which connects the middle section 53 to the first abutting portion 151. More specifically, the bent portion 154 connects the middle section 53 to the first abutting portion 151 by bending outward in the radial direction of the port liner 150 and towards the inner wall W of the exhaust port 30*b* such that the first abutting portion 151 abuts the inner wall W of the exhaust port 30*b*. That is to say, in a radial direction of the port liner 150, a distance from the first abutting portion 151 to the center axis of the port liner 150 is larger than a distance from the middle section 53 to the center axis.

It should be noted, in a radial direction of the port liner 150, a distance between the bent portion 154 and the inner wall W in a radial direction of the port liner 150 changes gradually in a axial direction of the port liner 150. In other words, the bent portion 154 does not make a 90 degree angle with the inner wall W of the exhaust port 30*b*. When the bent portion 154 is configured to make a 90 degree angle with the inner wall W, the port liner 150 may be pushed back towards the exhaust pipe 40 by a force of the exhaust gas due to a large resistance force to the flow of exhaust gas created by the bent portion 154. By gradually increasing the distance between the bent portion 154 and the inner wall W from the first abutting portion 51 towards the combustion chamber side, a position of the port liner 150 may be fixed while preventing the bent portion 154 from generating an excessive resistance to the flow of exhaust gas flowing out of the combustion chamber 30*c*.

Figure 9:
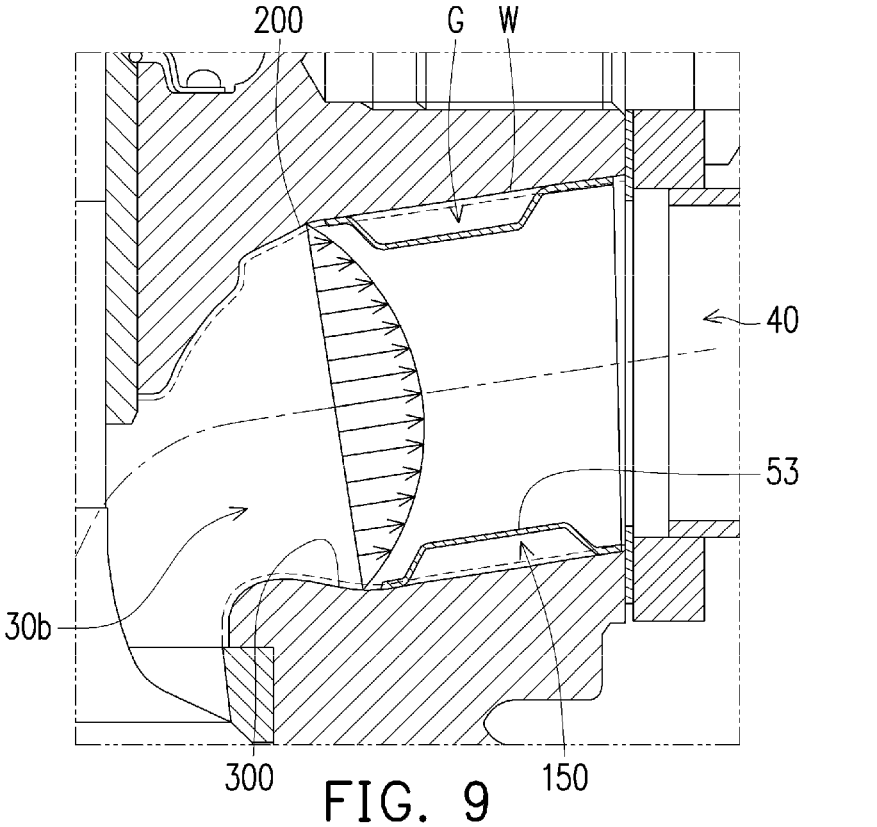
FIG. 9 is a cross sectional diagram schematically showing a flow of exhaust gas in the exhaust structure of FIG. 8.

FIG. 9 is a cross sectional diagram schematically showing a flow of exhaust gas in the exhaust structure of FIG. 8. Referring to FIG. 9, a flow rate of the exhaust gas is shown. A center portion of the exhaust port 30*b* has a higher flow rate of exhaust gas. The flow rate of exhaust gas decreases gradually from the center portion of the exhaust port to the inner wall W of the exhaust port 30*b*. It should be noted, the port liner 150 expands when pressure from the exhaust gas is received. More specifically, the middle section 53 of the port liner 150 expands outward in the radial direction towards the inner wall W of the exhaust port 30*b*. However, the middle section 53 does not contact the inner wall W.

Figure 10:
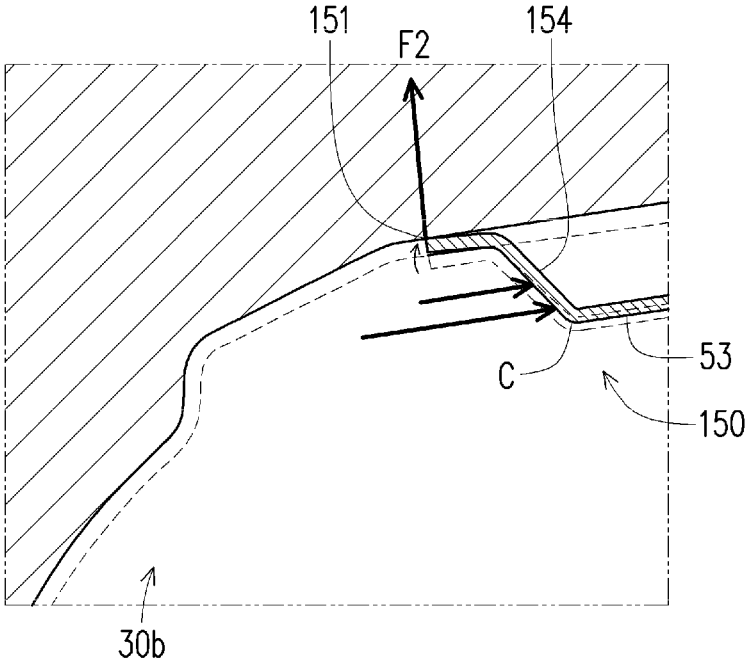
FIG. 10 is a cross sectional diagram schematically showing an enlarged view of a bent portion of a heat insulating component of FIG. 9.

FIG. 10 is a cross sectional diagram schematically showing an enlarged view of a bent portion of a heat insulating component of FIG. 9. Referring to FIG. 10, in the second embodiment, the bent portion 154 is bent such that the first abutting portion 151 is disposed closer to the combustion chamber side than a connecting point C connecting the middle section 153 and the bent portion 154, and the first abutting portion 151 abuts and extends along the inner wall W of the exhaust port 30*b* and connects with the middle section 53. By this design, the pressure received by the bent portion 154 from the exhaust gas is transmitted to the inner wall W of the exhaust port 30*b* in a force F2 direction, and the port liner 154 is more strongly fixed.

In the present embodiment, the bent portion 154 is provided in an annular shape. By hollowing the center portion of the port liner 150, the pressure of the exhaust gas flowing near the inner wall W of the exhaust port 30*b* may be received by an entire circumferential surface of the port liner 150 such that the port liner 150 is more strongly fixed, without blocking the flow of the exhaust gas.

Furthermore, the bent portion 154 is configured such that the first abutting portion 151 abuts at least a portion of the inner wall W of the exhaust port 30*b* which is located at an upper part of the exhaust port 30*b* related to a base portion of the internal combustion engine 100, That is to say, the first abutting portion 151 abuts at least the inner wall W of the exhaust port 30*b* at the outside circumference 200 where the exhaust gas hits the inner wall W of the exhaust port 30*b* particularly hard. By providing the first abutting portion 151 of the port liner 150 at a location in the exhaust port 30*b* where the exhaust gas flowing in the curved path hits particularly hard (the flow speed is fast), a force of the exhaust gas is more strongly received, such that the port liner 150 is more strongly fixed.

It should be noted, the flow of exhaust gas in the exhaust structure 500*a* shown in FIG. 9 depicts a slower velocity of exhaust gas near the inner wall W of the exhaust port 30*b* as compared to the center portion. However, experiments show that, if the flow rate of the exhaust gas measured at the upper part of the exhaust port 30*b* that is located at the outside circumference 200 of the exhaust port 30*b* related to the base portion of the internal combustion engine 100 is compared with the flow rate of the exhaust gas measured at the lower part of the exhaust port 30*b* that is located at the inside circumference 300 of the exhaust port 30*b* at the base portion of the internal combustion engine 100, the flow rate of the exhaust gas flowing along the curved path of the outside circumference 200 hits particularly harder, i.e., the flow rate is larger, than that flowing at the inside circumference 300.

The trailing bend 55 is a portion of the port liner 150 which connects the middle section 53 to the second abutting portion 52. More specifically, the trailing bend 55 connects the middle section 53 to the second abutting portion 52 by bending outward in the radial direction of the port liner 150 and towards the inner wall W of the exhaust port 30*b* such that the second abutting portion 52 abuts the inner wall W of the exhaust port 30*b*. That is to say, in a radial direction of the port liner 150, a distance from the second abutting portion 52 to the center axis of the port liner 150 is larger than a distance from the middle section 53 to the center axis.

The trailing bend 55 is bent such that the second abutting portion 52 is disposed closer to the exhaust pipe side than a connecting point D connecting the middle section 53 and the trailing bend 55, and the second abutting portion 52 abuts and extends along the inner wall W of the exhaust port 30*b* and connects with the middle section 53. It should be noted, a distance between the trailing bend 55 and the inner wall W increases gradually from the second abutting portion 52 to the middle section 53 of the port liner 150. In other words, the trailing bend 55 does not make a 90 degree angle with the inner wall W of the exhaust port 30*b*.

Although embodiments of a self fitting port liner of the disclosure have been described above based on some examples, the disclosure is not limited to the port liner in which an attachment/fixing part(s) is not used. An attachment part or a fixing part may be used in other embodiments of the disclosure.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An exhaust structure is installed in an internal combustion engine having an exhaust passage that communicates between an exhaust port of a combustion chamber and an exhaust pipe, the exhaust structure comprising:

a heat insulating component covering at least a portion of an inner wall of the exhaust port, wherein the heat insulating component comprises:

a first abutting portion disposed at a first side of the heat insulating component at a combustion chamber side and abutting the inner wall of the exhaust port;

a second abutting portion disposed at a second side of the heat insulating component at an exhaust pipe side and abutting the inner wall of the exhaust port;

a middle section disposed between the first side and the second side of the heat insulating component, wherein a gap is formed between the middle section of the heat insulating component and the inner wall of the exhaust port; and a bent portion connecting the middle section and the first abutting portion and bending toward the inner wall of the exhaust port from the middle section, wherein a distance between the bent portion and the inner wall in a radial direction of the heat insulating component changes gradually in an axial direction of the heat insulating component, wherein the bent portion is bent such that the first abutting portion is disposed closer to the exhaust pipe side than a connecting point connecting the middle section and the bent portion.

2. The exhaust structure of the internal combustion engine according to claim 1, wherein the bent portion is configured to be deformed so that a formed angle between the middle section and the bent portion increases with a receiving heat.

3. The exhaust structure of the internal combustion engine according to claim 1, wherein the bent portion is provided in an annular shape.

4. The exhaust structure of the internal combustion engine according to claim 1, wherein the bent portion is configured such that the first abutting portion abuts at least a portion of the inner wall of the exhaust port which is located at an upper part of the exhaust port related to a base portion of the internal combustion engine.

* * * * *